US010020594B2

(12) United States Patent
Kim et al.

(10) Patent No.: US 10,020,594 B2
(45) Date of Patent: Jul. 10, 2018

(54) ARRAY ANTENNA

(71) Applicant: GWANGJU INSTITUTE OF SCIENCE AND TECHNOLOGY, Gwangju (KR)

(72) Inventors: Kang wook Kim, Gwangju (KR); Yun su Kang, Gwangju (KR)

(73) Assignee: GWANGJI INSTITUTE OF SCIENCE AND TECHNOLOGY, Gwangju (KR)

( * ) Notice: Subject to any disclaimer, the term of this patent is extended or adjusted under 35 U.S.C. 154(b) by 0 days.

(21) Appl. No.: 15/331,353

(22) Filed: Oct. 21, 2016

(65) Prior Publication Data

US 2017/0117638 A1 Apr. 27, 2017

Related U.S. Application Data

(60) Provisional application No. 62/244,206, filed on Oct. 21, 2015.

(30) Foreign Application Priority Data

Oct. 20, 2016 (KR) ..... 10-2016-0136697

(51) Int. Cl.
*H01Q 21/00* (2006.01)

(52) U.S. Cl.
CPC ..... *H01Q 21/0006* (2013.01)

(58) Field of Classification Search
CPC ..... H01Q 21/00; H01Q 9/0407
USPC ..... 343/853, 893, 700 MS
See application file for complete search history.

(56) References Cited

U.S. PATENT DOCUMENTS 4,843,400 A * 6/1989 Tsao ..... H01Q 9/0428 343/700 MS
5,661,494 A * 8/1997 Bondyopadhyay .... H01Q 1/364 343/700 MS
6,008,763 A * 12/1999 Nystrom ..... H01Q 21/08 343/700 MS
6,133,882 A * 10/2000 LaFleur ..... H01Q 1/38 343/700 MS
6,864,840 B2 * 3/2005 Zhu ..... H01P 1/181 343/700 MS
9,537,221 B2 * 1/2017 Maruyama ..... H01Q 15/008
2012/0319924 A1 * 12/2012 Fuchs ..... H01Q 5/321 343/893

* cited by examiner

*Primary Examiner* — Dameon E Levi
*Assistant Examiner* — Hasan Islam
(74) *Attorney, Agent, or Firm* — Hauptman Ham, LLP

(57) ABSTRACT

Disclosed herein is an array antenna in which a plurality of radiating elements is arranged. The array antenna includes: a first layer comprising a first substrate forming an upper portion of the array antenna and a plurality of radiating elements disposed on the first substrate; a second layer comprising a second substrate forming a lower portion of the array antenna and a feedline disposed on the second substrate to supply output power to the plurality of radiating elements; and a third layer formed between the first layer and the second layer and comprising a ground plane and an aperture slot formed through the ground plane.

17 Claims, 16 Drawing Sheets

ARRAY ANTENNA

CROSS REFERENCE TO RELATED APPLICATION

This application claims the benefit of U.S. Provisional Patent Application No. 62/244,206 filed on Oct. 21, 2015, entitled "ARRAY ANTENNA", and Korean Patent Application No. 10-2016-0136697, filed on Oct. 20, 2016, entitled "ARRAY ANTENNA", which is hereby incorporated by reference in its entirety into this application.

BACKGROUND

1. Technical Field

The present invention relates to an array antenna having a structure in which a plurality of antenna elements is arranged in a predetermined fashion. More particularly, the present invention relates to a series-fed phased array antenna which can electronically steer an antenna beam through variation in frequency.

2. Description of the Related Art

Generally, in a radio communication system, an antenna is used to send and receive signals and the length of an antenna depends on the frequency to be transceived. Such antennas have developed into various forms as technology evolves. Recently, many studies have been made to develop a method of using multiple antennas.

Particularly, array antennas having a structure in which multiple antennas are arranged in a predetermined fashion are widely used. Such an array antenna is a device that uses a large number of radiating elements to acquire a narrow beam width and transmit a signal. When using the array antenna at broadband frequency, beam direction, efficiency, unit cost, and the like may vary depending on the type of feed network.

Generally, when a parallel feed network is used, the beam direction is fixed even when the frequency to be transmitted changes. However, as the overall length of the feed network increases, signal loss along a transmission line increases and transmission efficiency drops when the transmission line is constructed using a dielectric substrate. In addition, when a transmission line of a parallel feed network is constructed using a waveguide, the feed network becomes complicated, thereby making it difficult to manufacture the network while increasing manufacturing costs.

Conversely, a series feed network can reduce efficiency loss and manufacturing difficulty as mentioned above and can solve increase in unit price. However, when the series feed network is used, a transmission signal fed to a radiating element, that is, the phase of electromagnetic waves, also changes according to frequency change, and the direction of a main beam also changes. As a result, gain according to frequency changes dramatically to affect transmission and reception. Especially, in the case of a high gain array antenna, this effect is even larger due to very narrow beam width. Therefore, there is a need for a solution to this problem.

BRIEF SUMMARY

It is one aspect of the present invention to provide a phased array antenna which can electronically steer an antenna beam by varying the frequency of applied signals without using a phase shifter or a physical/mechanical device generally used in a typical automotive phased array antenna.

In accordance with one aspect of the present invention, an array antenna includes: a first layer including a first substrate forming an upper portion of the array antenna and a plurality of radiating elements disposed on the first substrate; a second layer including a second substrate forming a lower portion of the array antenna and a feedline disposed on the second substrate to supply output power to the plurality of radiating elements; and a third layer formed between the first layer and the second layer and including a ground plane and an aperture slot formed through the ground plane.

BRIEF DESCRIPTION OF THE DRAWINGS

The above and other aspects, features, and advantages of the present invention will become apparent from the detailed description of the following embodiments in conjunction with the accompanying drawings, in which.

DETAILED DESCRIPTION

Hereinafter, exemplary embodiments of the present invention will be described in detail with reference to the accompanying drawings. It should be understood that the present invention is not limited to the following embodiments and may be easily embodied in different ways through addition, modification, or deletion of elements by those skilled in the art without departing from the scope of the present invention.

The present invention relates to a series-fed phased array antenna which can steer an antenna beam at an angle of 45 degrees to produce a phase difference between antenna elements arranged in series by changing frequencies applied to the array antenna.

Figure 1:
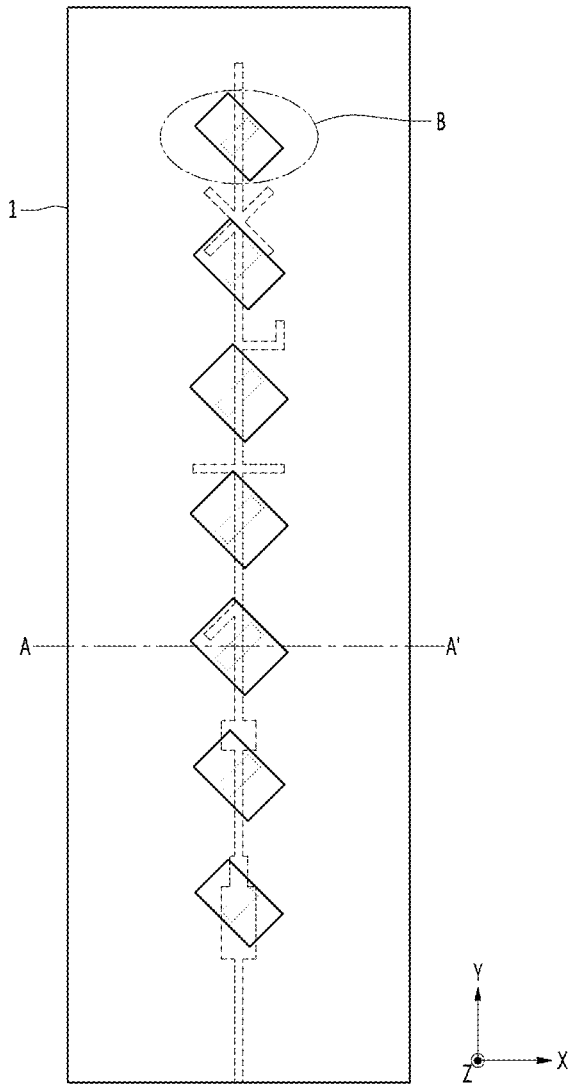
FIG. 1 is a top view of an array antenna according to one exemplary embodiment of the present invention, specifically a series-fed antenna.

FIG. 1 is a top view of an array antenna according to one exemplary embodiment of the present invention, specifically a series-fed array antenna.

Referring to FIG. 1, an array antenna 1 according to one exemplary embodiment of the present invention may include a plurality of radiating elements arranged in series, a substrate, an aperture slot, and a feedline.

The array antenna 1 according to the exemplary embodiment may be composed of three layers. Details of each layer will now be described with reference to FIG. 2.

Figure 2:
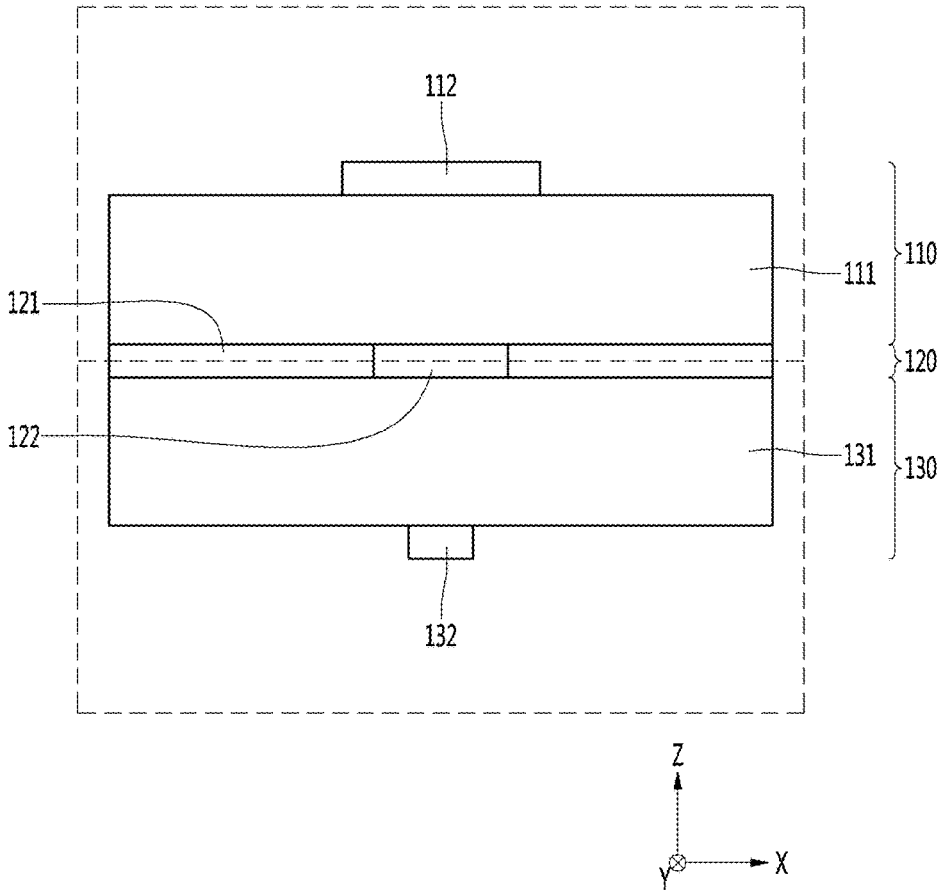
FIG. 2 is a cross-sectional view taken along line A-A' of FIG. 1.

FIG. 2 is a cross-sectional view taken along line A-A' of FIG. 1.

Referring to FIG. 2, the array antenna according to the exemplary embodiment may be composed of a first layer 110, a second layer 120, and a third layer 130.

The first layer 110 forms an upper portion of the antenna. The first layer 110 may include a first substrate 111 and a radiating element 112. Herein, the first substrate 111 may also be referred to as an antenna substrate. The radiating element 112 may be disposed on the first substrate. The radiating element 112 radiates an antenna beam. In one exemplary embodiment, the radiating element 112 may be disposed on an upper side of the first substrate 110.

The radiating element 112 includes a plurality of radiating elements arranged in series in an extension direction of a feedline (Y-axis direction). The plurality of radiating elements may be different in size and shape.

The third layer 130 forms a lower portion of the antenna and may include a second substrate 131 and a feedline 132. The second substrate 131 may be provided under the first substrate 111. The second layer 120 is interposed between the first substrate and the second substrate. The feedline 132 may be formed on a lower surface of the second substrate 131 and extend in the direction in which the radiating elements 112 are arranged.

The second layer 120 may include a ground plane 121 and an aperture slot 122. In a typical array antenna, parasitic radiation is generated from the feedline in a power supply mode where the antenna is powered by a transmitter. The ground plane 121 may provide shielding against parasitic radiation from the feedline 132. Specifically, the parasitic radiation can be prevented by aperture-coupling through the aperture slot 121 of the ground plane 121. Thus, the second layer allows the array antenna to operate over a wide bandwidth and exhibit high-purity polarization characteristics. The aperture slot 122 may be formed to be included in the inner region of the radiating element when seen from above, as in FIG. 1.

In addition, the feedline 132 of the array antenna according to this exemplary embodiment may have various different shapes due to aperture-coupling through the aperture slot, as shown in FIG. 2. Specifically, portions of the feedline 132 connecting adjacent radiating elements 112 may have different lengths to change a phase contrast applied to each of the radiating elements 112. For example, the feedline 132 may be relatively long to increase a phase contrast applied to each of the radiating elements 112 in order to adjust beam angle over a wide range through relatively small change in frequency. As a result, a frequency change value is decreased, thereby reducing change in gain characteristics of the radiating element 112.

Figure 3:
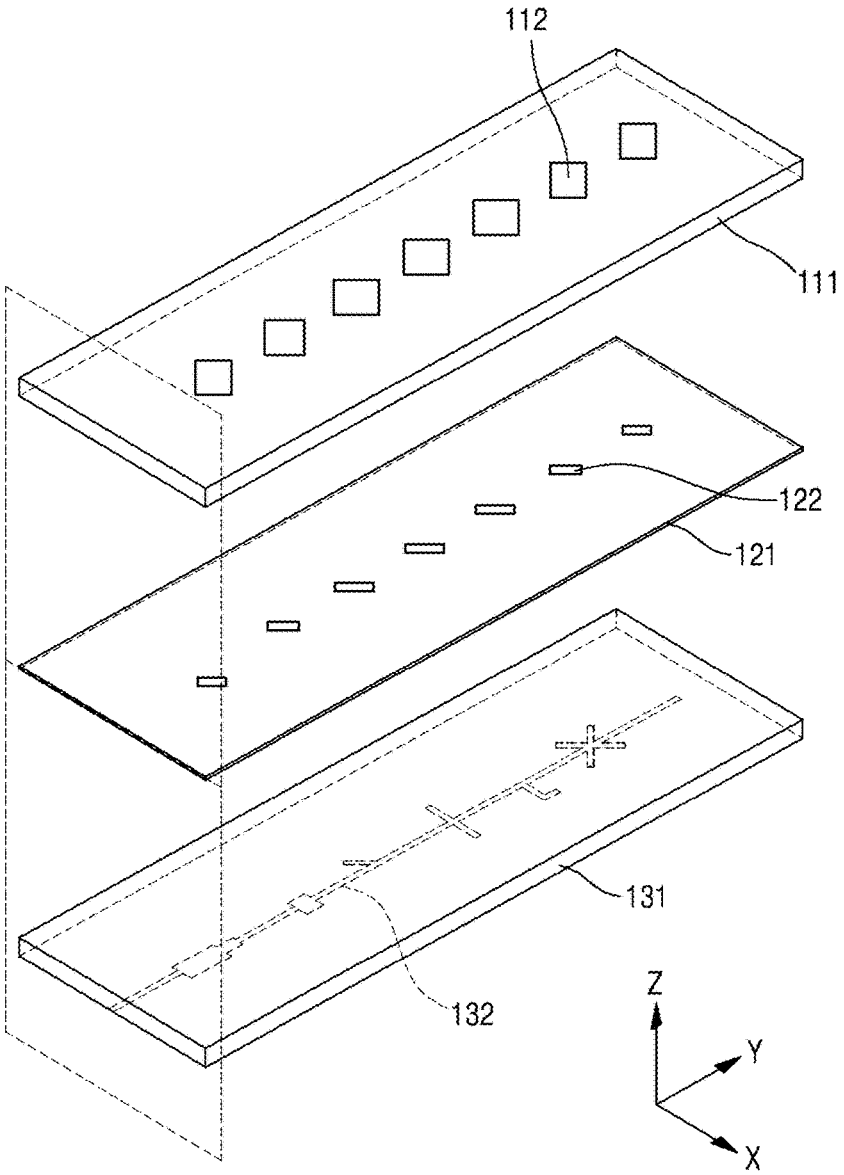
FIG. 3 is a three-dimensional diagram of the array antenna of FIG. 1.

FIG. 3 is a three-dimensional diagram of the array antenna shown in FIG. 1. As described with reference to FIG. 2, the plurality of radiating elements 112 may be arranged in series on the first substrate 111. The feedline 132 may be disposed on the second substrate 131. In addition, the ground plane 121 may be disposed between the first substrate 111 and the second substrate 131, and the aperture slot 122 may be formed in the ground plane 121 for each of the radiating elements 112.

Figure 4A:
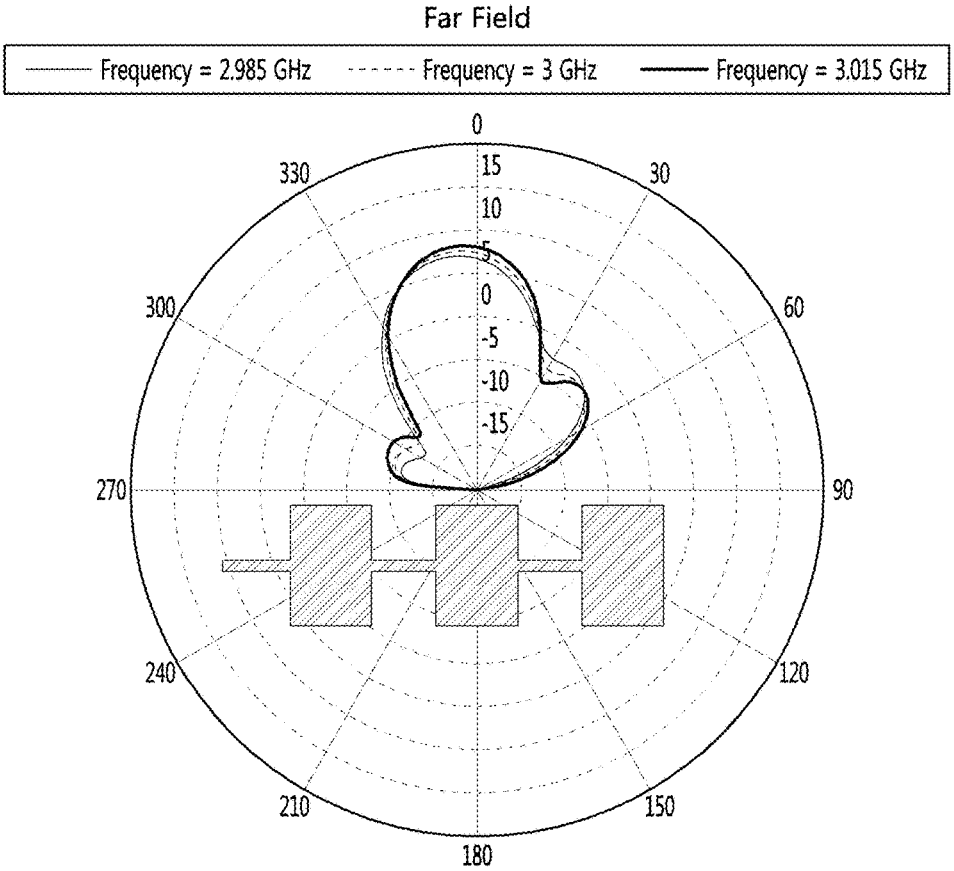
FIGS. 4*a* to 4*c* are views showing variation in beam angle according to frequency change, as measured for different lengths of the feedline.
Figure 4B:
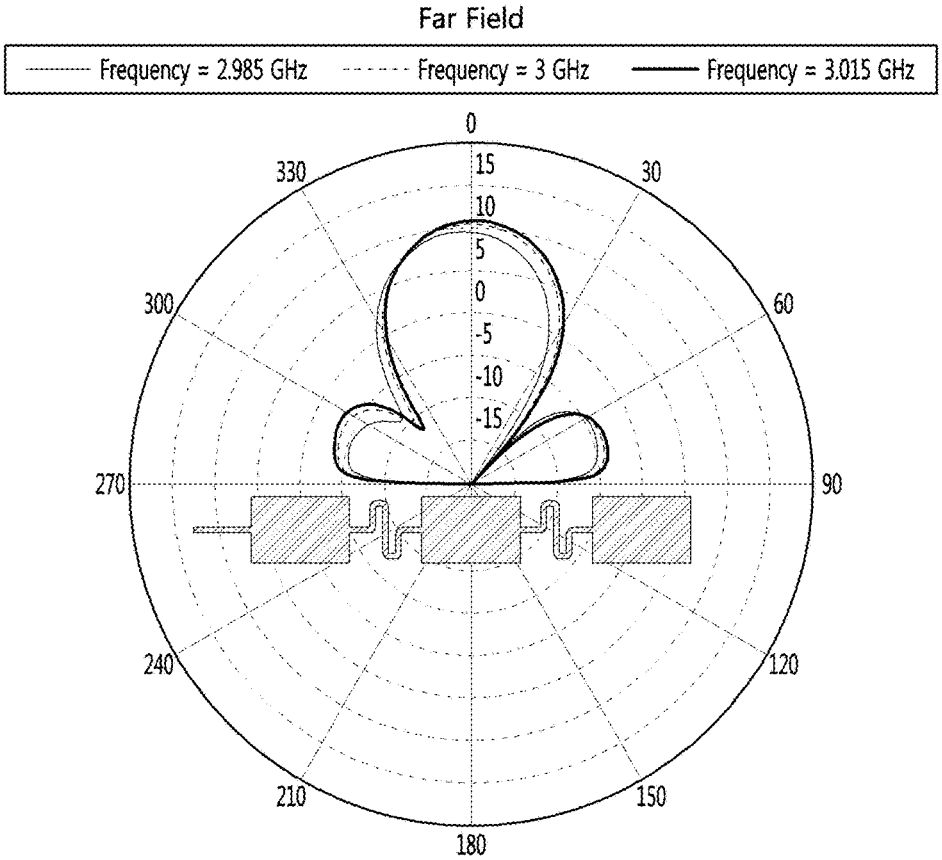
Figure 4C:
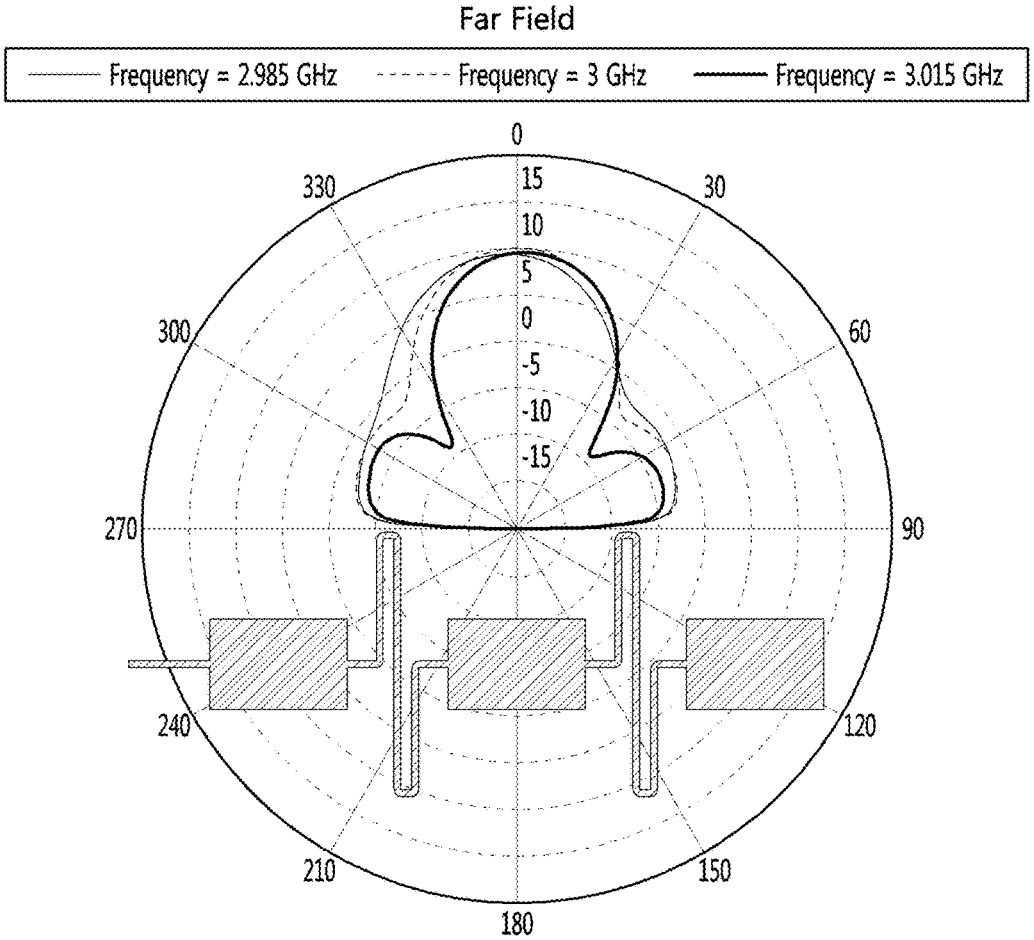

FIGS. 4*a* to 4*c* are views showing variation in beam angle according to frequency change, as measured for different lengths of the feedline. In FIG. 4*a*, a series-fed microstrip array antenna is shown. In FIG. 4*b*, an aperture coupled array antenna having a relatively short twisted feedline is shown. In FIG. 4*c*, an aperture coupled array antenna having a relatively long twisted feedline is shown.

Referring to FIGS. 4*a* to 4*c*, it can be seen that the aperture coupled array antennas (FIG. 4*b*, FIG. 4*c*) have greater variation in a direction of an antenna beam according to frequency change than the microstrip array antenna (FIG. 4*a*). In addition, it can be seen that variation in direction of an antenna beam according to frequency change can be controlled by adjusting the length of the feedline and a position at which the feedline is twisted.

Figure 5:
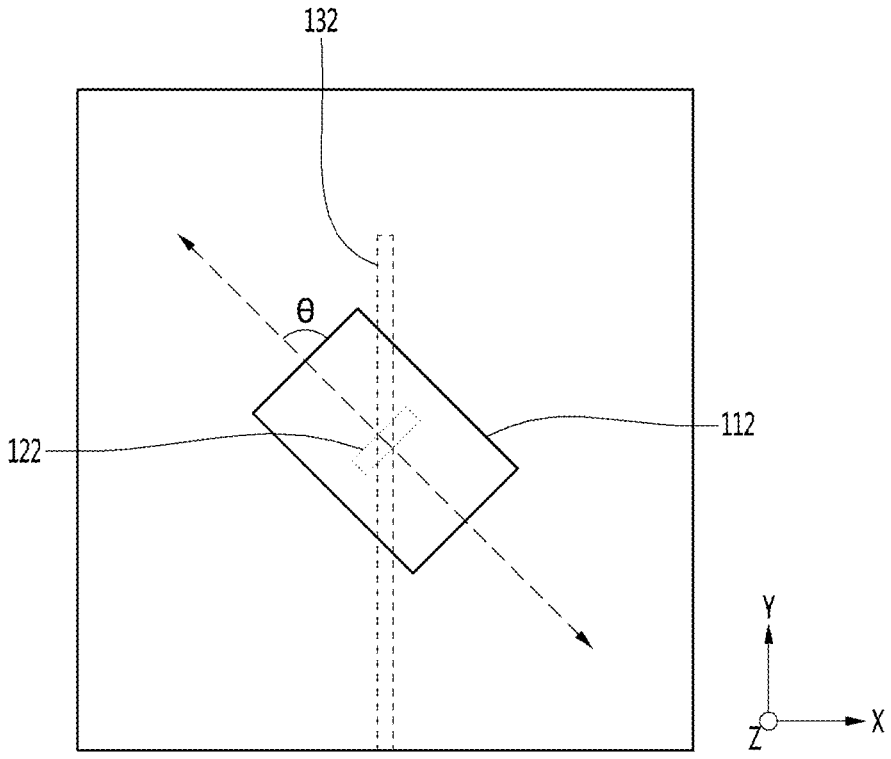
FIG. 5 is an enlarged view of area B of FIG. 1.

FIG. 5 is an enlarged view of area B of FIG. 1.

Referring to FIG. 5, the radiating element 112 of the array antenna 1 according to the exemplary embodiment may be tilted to the left by an angle θ with respect to the feedline 132. Here, the radiating elements 112 may be tilted with respect to the feedline 132 in the same direction, that is, to the left or to the right. Preferably, the polarization direction (θ) of the radiating element of the antenna is 45 degrees to eliminate interference of electromagnetic waves from an antenna of a vehicle opposite a vehicle equipped with the array antenna according to the present invention.

Figure 6:
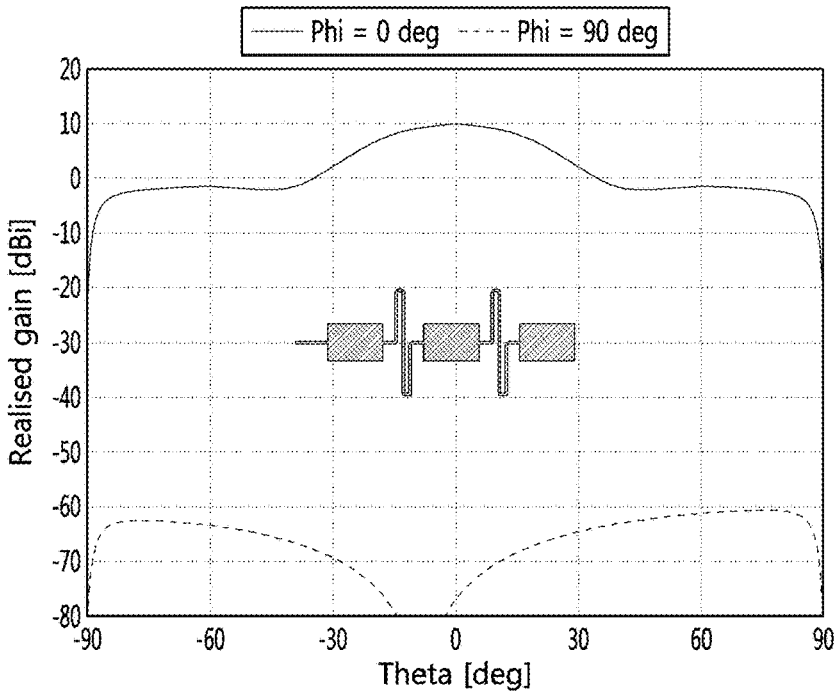
FIG. 6 is a view showing variation in degree of elimination of electromagnetic interference according to change in polarization direction of the radiating element.
Figure 6:
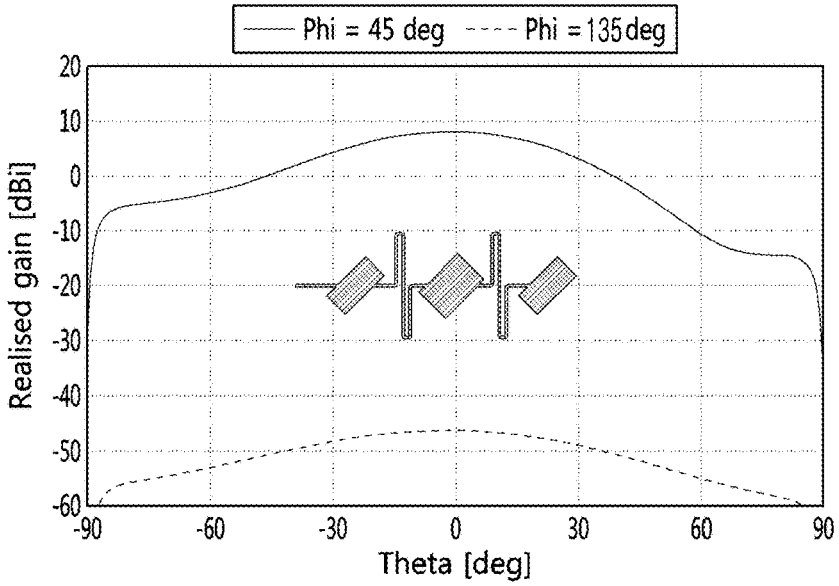

FIG. 6 is a view showing variation in degree of elimination of electromagnetic interference according to change in polarization direction of the radiating element.

Referring to FIG. 6, it can be seen that there is a difference in gain difference between a first plane (A) and a second plane (B) between case (a) where the radiating element 132 is not tilted and case (b) where the radiating element 132 is tilted. Specifically, it can be seen that, in case (b), a gain difference between the first plane (A) and the second plane (B) is about 50 dB, which indicates good polarization characteristics. Therefore, it can be seen that when the polarization direction of the radiating element 132 with respect to the feedline 132 is 45 degrees, it is possible to eliminate interference of electromagnetic waves from an array antenna at the opposite side including the radiating elements tilted by the same angle.

Figure 7:
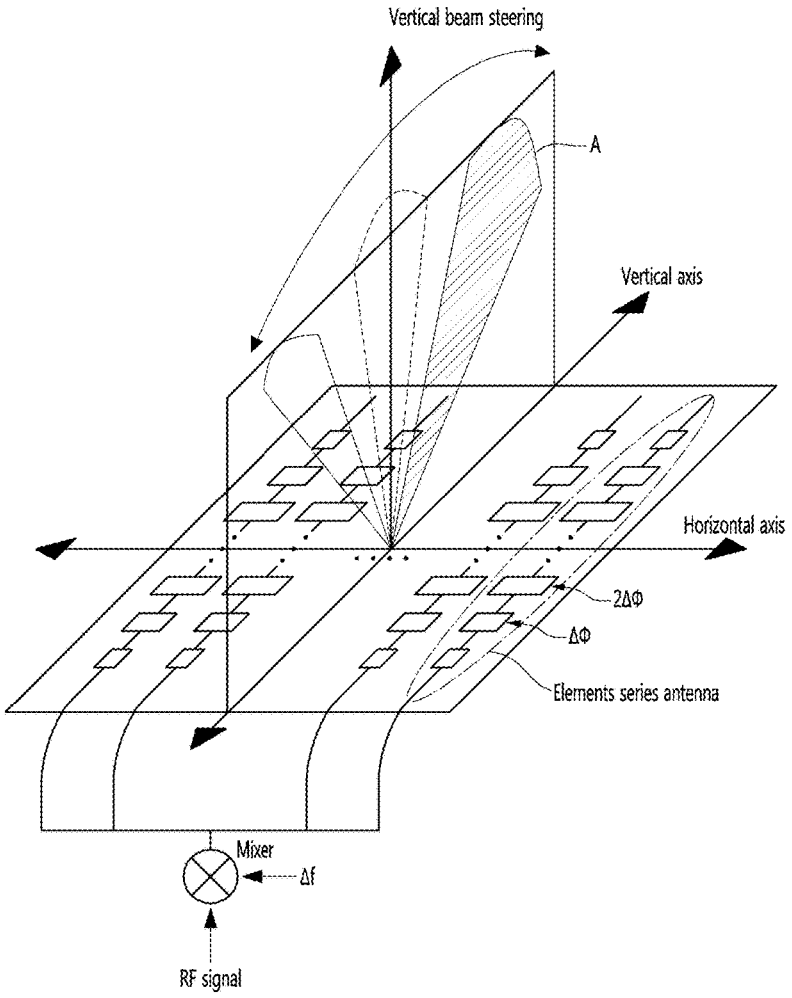
FIG. 7 shows a result when a delta-mode frequency scanning array is applied to the series-fed array antenna according to the exemplary embodiment of the present invention.

FIG. 7 shows a result when a delta-mode frequency scanning array is applied to the series-fed array antenna according to the exemplary embodiment. Here, the delta-mode frequency scanning array means that the frequency applied to the radiating elements is varied to change the direction of a radiated beam.

Variation in frequency applied to the feedline 132 causes a constant difference between phases applied to the radiating elements 112, whereby an in-phase-plane (A) can be adjusted to control the direction of an antenna beam. In other words, variation in the frequency of a current applied to the plurality of radiating elements causes a constant difference between phases applied to the radiating elements. As a result, the in-phase-plane is tilted in a certain direction.

Figure 8A:
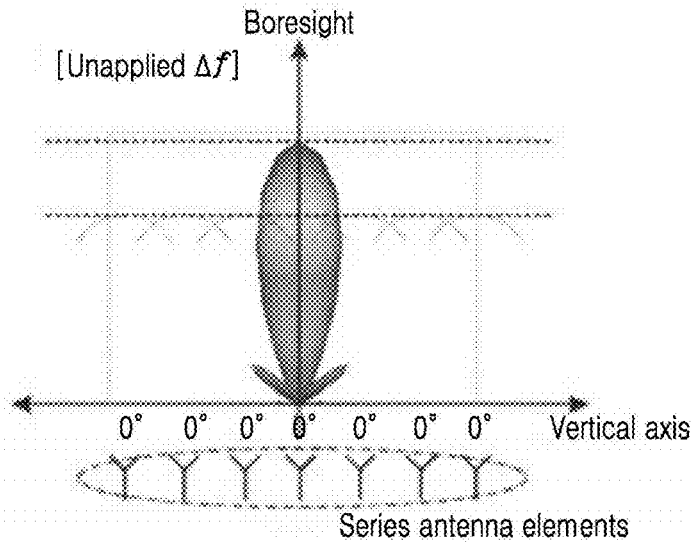
FIGS. 8*a*, 8*b*, 9*a*, and 9*b* are views comparing outcomes before and after the delta-mode frequency scanning array is applied to the series-fed array antenna, as shown in FIG. 7.
Figure 8B:
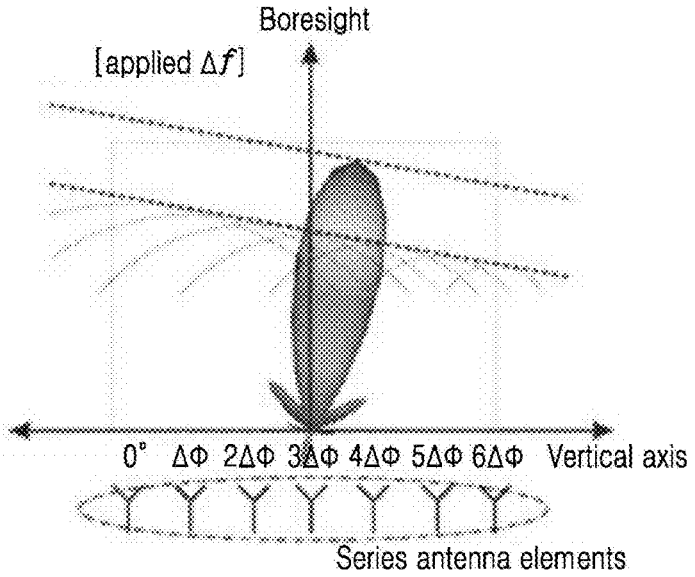
Figure 9A:
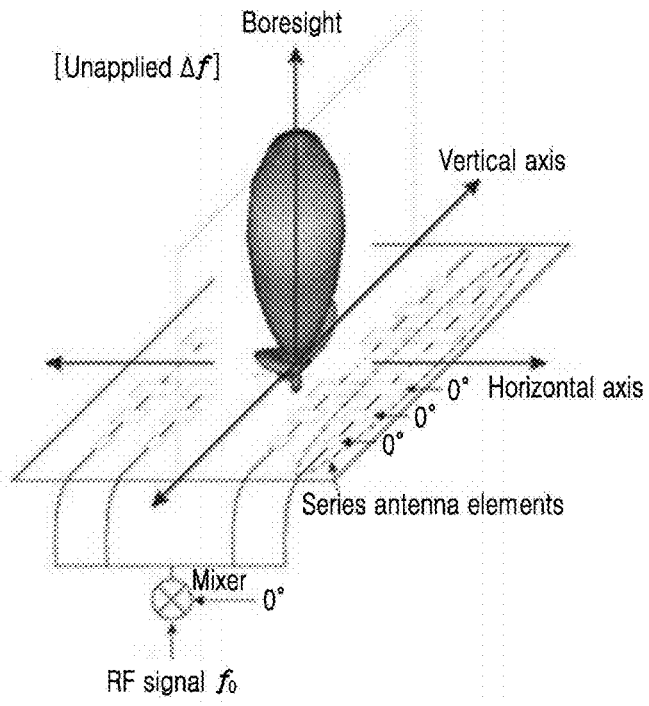
Figure 9B:
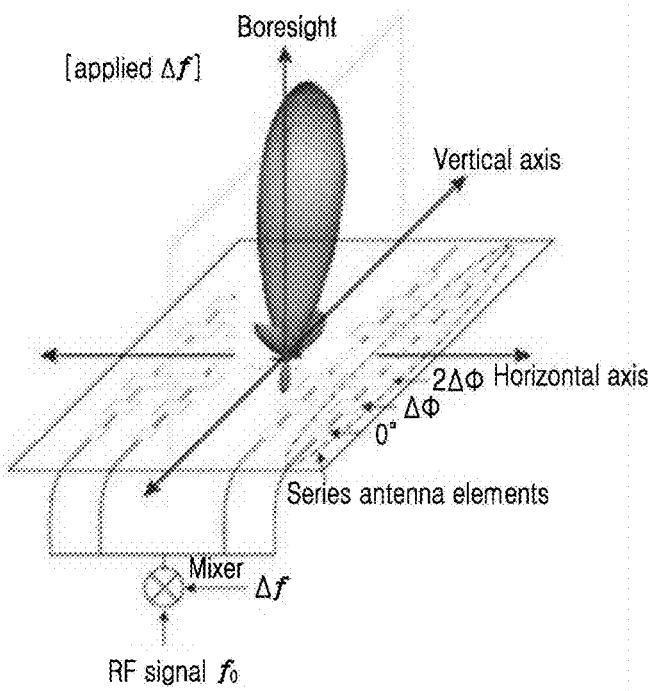

FIGS. 8*a*, 8*b*, 9*a* and 9*b* are views comparing outcomes before and after the delta-mode frequency scanning array is applied to the series-fed array antenna shown in FIG. 7. Specifically, FIGS. 8*a*, 8*b* are a two-dimensional diagram comparing outcomes before and after application of the delta-mode frequency scanning array and FIGS. 9*a*, 9*b* is a three-dimensional diagram comparing outcomes before and after application of the delta-mode frequency scanning array.

As shown in FIGS. 8*a*, 8*b*, 9*a* and 9*b*, when resonance frequency (f_0) of the feedline 132 is varied (ΔF), a constant difference occurs between phases applied to the radiating elements 112. Referring to FIGS. 8*b* and 9*b* (applied Δf), an antenna beam may be steered through adjustment of the in-phase plane defined by the radiating elements 112.

Figure 10A:
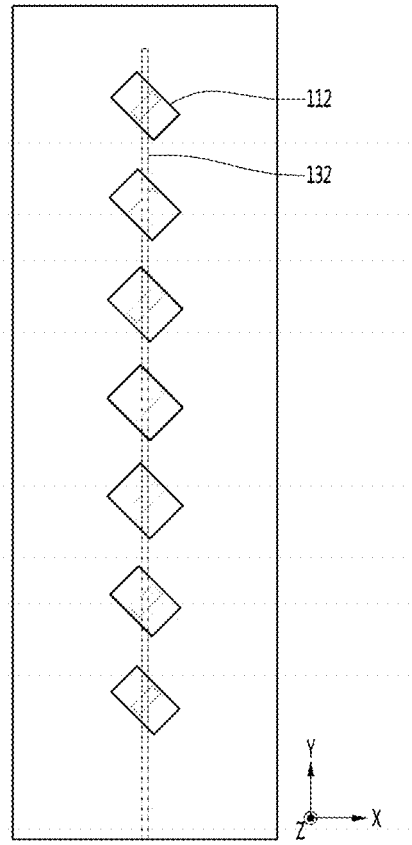
FIGS. 10*a*, 10*b* are a view of an example of tapering the size of the components of the antenna.
Figure 10B:
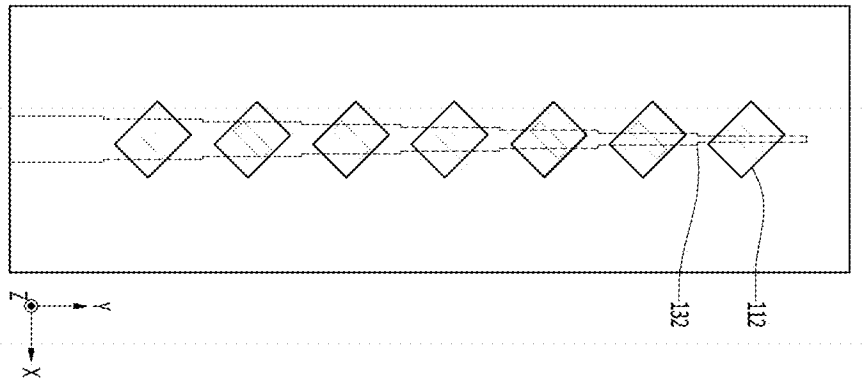

FIGS. 10*a*, 10*b* are a view of an example of tapering the size of components of the antenna. Referring to FIGS. 10*a*, 10*b*, tapering of the components may be adjusting the width of the radiating elements 112 to control radiance (FIG. 10*a*) or adjusting the width of the feedline 132 to control radiance through impedance matching (FIG. 10*b*).

Referring to FIG. 10*a*, the radiating elements 112 arranged in series along the feedline may have different sizes. Preferably, a radiating element at the center has the largest size and the sizes of the radiating elements gradually decrease toward an edge such that radiance of the radiating elements can be controlled.

Referring to FIG. 10*b*, the width of the feedline disposed on a lower surface of the substrate and extending in the Y-axis direction may become narrower in one direction. Preferably, portions of the feedline between adjacent radiating elements have different widths.

Figure 11:
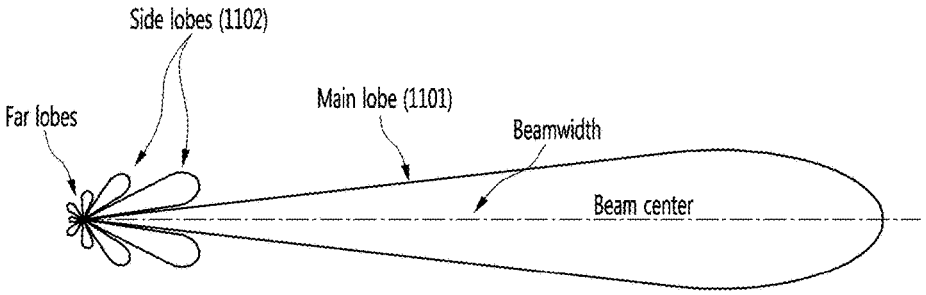
FIG. 11 is a schematic view of a beam radiated from the antenna.

FIG. 11 is a schematic view of a beam radiated from the antenna.

As described above, the array antenna according to the exemplary embodiment can control radiance of the antenna through variation in the size of the radiating elements or the width of the feedline, thereby controlling the size of antenna lobes to generate an antenna beam advantageous for detection of a target and non-target objects.

Specifically, in an antenna beam pattern, a target to be detected by the antenna is located at a main lobe 1101 and non-target objects are located at side lobes 1102. Here, a difference between maximum values of antenna gains of the main lobe and the side lobes is referred to as a side low level (SLL). A higher SLL results in a greater difference between amounts of electromagnetic waves emitted from the array antenna to the main lobe and the side lobes. In other words, a higher SLL causes a larger amount of electromagnetic waves to be radiated to the main lobe at which a target is located and a smaller amount of electromagnetic waves to be radiated to the side lobes, and thus is more advantageous for detection of the target.

As shown in FIG. 10*a*, 10*b*, when tapering is applied to the array antenna, SLL becomes higher, thereby facilitating detection of a target.

The array antenna according to the present invention can electronically steer an antenna beam through variation in frequency of applied signals without using a phase shifter or a physical/mechanical device generally used in a typical automotive phased array antenna.

As such, according to the exemplary embodiment, the phased array antenna can eliminate parasitic radiation from a feedline using aperture coupling, operate over a wide bandwidth, and exhibit high-purity polarization characteristics.

In addition, the phased array antenna according to the exemplary embodiment can eliminate interference of electromagnetic waves from a vehicle at the opposite side by tilting the polarization direction of the antenna by an angle of 45 degrees.

Further, the phased array antenna according to the exemplary embodiment can steer an antenna beam through variation in frequency by arranging antenna elements in series.

Furthermore, the phased array antenna according to the exemplary embodiment can generate an antenna beam advantageous for detection of a target and non-target objects by adjusting radiance of antenna elements to reduce the size of antenna side lobes.

Although some exemplary embodiments have been described with reference to the drawings, it should be understood that the present invention is not limited to these embodiments, and that various modifications, changes, and alterations can be made without departing from the spirit and scope of the invention. Therefore, the scope of the invention should be limited only by the accompanying claims and equivalents thereof.

What is claimed is:

1. An array antenna in which a plurality of radiating elements is arranged to radiate an antenna beam, the antenna array comprising:

a first layer comprising a first substrate and a plurality of radiating elements on the first substrate;

a second layer comprising a second substrate and a feedline on the second substrate, the feedline extending in a longitudinal direction of the second substrate and being configured to supply output power to the plurality of radiating elements, and to apply different frequencies to the plurality of radiating elements, respectively; and a third layer between the first layer and the second layer, the third layer comprising a ground plane and an aperture slot through the ground plane, wherein the radiating elements are tilted by a predetermined angle with respect to the feedline, and a width of the feedline becomes narrower from a first end of the feedline to a second end of the feed line opposite the first end in the longitudinal direction.

2. The array antenna according to claim 1, wherein there is a constant difference between the frequencies applied to the plurality of radiating elements.

3. The array antenna according to claim 1, wherein the radiating elements have different sizes.

4. The array antenna according to claim 1, wherein a radiating element at the center has the largest size and sizes of the radiating elements gradually decrease toward an edge.

5. The array antenna according to claim 1, wherein portions of the feedline corresponding to the respective radiating elements have different widths.

6. The array antenna according to claim 1, wherein an angle defined between the feedline and the radiating elements is 45 degrees.

7. The array antenna according to claim 1, wherein the plurality of radiating elements are tilted with respect to the feedline in a same direction.

8. The array antenna according to claim 1, wherein the feedline is branched off at portions corresponding to the plurality of radiating elements.

9. An array antenna comprising:

a first substrate having a first surface and a second surface opposite to the first surface;

a plurality of radiating elements on the first surface of the first substrate;

a second substrate having a third surface and a fourth surface opposite to the third surface;

a feedline on the fourth surface of the second substrate extending in a longitudinal direction of the second substrate configured to supply output power to the plurality of radiating elements, and applies different frequencies to the plurality of radiating elements, respectively;

a ground plane between the first substrate and the second substrate, the ground plane having a fifth surface and a sixth surface opposite to the fifth surface, the fifth surface facing the second surface of the first substrate, the sixth surface facing the third surface of the second substrate; and an aperture slot extending from the fifth surface to the sixth surface of the ground plane, wherein the radiating elements are tilted with respect to the feedline, and portions of the feedline between each of the radiating element have different widths.

10. The array antenna according to claim 9, wherein there is a constant difference between the frequencies applied to the plurality of radiating elements.

11. The array antenna according to claim 9, wherein the radiating elements have different sizes.

12. The array antenna according to claim 9, wherein a radiating element at the center has the largest size and sizes of the radiating elements gradually decrease toward an edge.

13. The array antenna according to claim 9, wherein the width of the feedline becomes narrower from a first end of the feedline to a second end of the feedline opposite the first end in a longitudinal direction.

14. The array antenna according to claim 9, wherein an angle defined between the feedline and the radiating elements is 45 degrees.

15. The array antenna according to claim 9, wherein the plurality of radiating elements are tilted with respect to the feedline in a same direction.

16. The array antenna according to claim 9, wherein the feedline is branched off at portions corresponding to the plurality of radiating elements.

17. The array antenna according to claim 9, wherein portions of the feedline between each of the radiating element have different lengths.

* * * * *